US012459764B2

(12) United States Patent
Yokoyama et al.

(10) Patent No.: US 12,459,764 B2
(45) Date of Patent: Nov. 4, 2025

(54) SHEET FEEDING DEVICE THAT FEEDS SHEET FROM MULTI TRAY, AND IMAGE FORMING APPARATUS

(71) Applicant: KYOCERA Document Solutions Inc., Osaka (JP)

(72) Inventors: Koki Yokoyama, Osaka (JP); Kei Wakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 45 days.

(21) Appl. No.: 18/739,676

(22) Filed: Jun. 11, 2024

(65) Prior Publication Data

US 2024/0425309 A1 Dec. 26, 2024

(30) Foreign Application Priority Data

Jun. 20, 2023 (JP) ..... 2023-101180

(51) Int. Cl.
*B65H 1/26* (2006.01)

(52) U.S. Cl.
CPC ..... *B65H 1/266* (2013.01); *B65H 2402/10* (2013.01); *B65H 2402/32* (2013.01); *B65H 2402/60* (2013.01); *B65H 2405/332* (2013.01); *B65H 2407/21* (2013.01)

(58) Field of Classification Search
CPC ..... B65H 1/04; B65H 1/266; B65H 2402/10; B65H 2402/32; B65H 2402/60; B65H 2405/332; B65H 2407/21
See application file for complete search history.

(56) References Cited

U.S. PATENT DOCUMENTS

2005/0158111 A1* 7/2005 Yang ..... B65H 1/04 400/624
2016/0137444 A1* 5/2016 Kasaishi ..... B65H 1/266 271/10.09
2018/0162664 A1* 6/2018 Furuta ..... B65H 5/38
2024/0288817 A1* 8/2024 Fukuma ..... B65H 1/04

FOREIGN PATENT DOCUMENTS

JP H0858993 A 3/1996

* cited by examiner

*Primary Examiner* — Prasad V Gokhale
(74) *Attorney, Agent, or Firm* — IP Business Solutions, LLC.

(57) ABSTRACT

In a sheet feeding device, when a multi tray is overlaid on a sheet cassette, a rib on the front-end portion of the multi tray is fitted in an engaging slit in the upper edge of a sidewall of the sheet cassette, and protrudes from the sidewall of the sheet cassette. When the sheet cassette and the multi tray overlaid thereon are inserted into an apparatus main body, a boss on the sidewall of the sheet cassette is pressed against a positioning member on an inner wall of the apparatus main body, via the rib protruding outward from the sidewall of the sheet cassette, so that the multi tray and the sheet cassette are set in position.

7 Claims, 10 Drawing Sheets

SHEET FEEDING DEVICE THAT FEEDS SHEET FROM MULTI TRAY, AND IMAGE FORMING APPARATUS

INCORPORATION BY REFERENCE

This application claims priority to Japanese Patent Application No. 2023-101180 filed on Jun. 20, 2023, the entire contents of which are incorporated by reference herein.

BACKGROUND

The present disclosure relates to a sheet feeding device including a multi tray and a sheet cassette, and an image forming apparatus including such sheet feeding device. In particular, the present disclosure relates to a technique to insert the multi tray and the sheet cassette in a unified form, into inside of the main body of the apparatus, and set the multi tray and the sheet cassette in position.

Some existing image forming apparatuses include the multi tray and the sheet cassette for supplying recording sheets, on which an image is to be formed, the sheet cassette and the multi tray being stacked in the up-down direction.

In addition, an image forming apparatus has been proposed that includes a multi-size cassette, on which sheet materials of two different sizes can be placed side by side, and pickup rollers for drawing out the sheet material of the respective sizes from the multi-size cassette, so that the sheet materials of two different sizes can be selectively supplied from a single multi-size cassette.

SUMMARY

The disclosure proposes further improvement of the foregoing techniques.

In an aspect, the disclosure provides a sheet feeding device to be installed in an image forming apparatus. The sheet feeding device includes a sheet cassette, a multi tray, an engaging slit, a boss, a rib, and a positioning member. The sheet cassette is configured to be removably inserted into inside of an apparatus main body of the image forming apparatus, through an opening in the apparatus main body. The multi tray is configured to be removably overlaid on an upper side of the sheet cassette. The engaging slit is formed in an upper edge of a sidewall of the sheet cassette. The boss is located adjacent to the engaging slit, on a side to which the sheet cassette is drawn out, and protruding in a lateral direction from the sidewall of the sheet cassette. The rib is protruding downward from a front-end portion of the multi tray. The positioning member is protruding from an inner wall of the apparatus main body. When the multi tray is overlaid on the sheet cassette, the rib on the front-end portion of the multi tray is fitted in the engaging slit in the upper edge of the sidewall of the sheet cassette, and protrudes from the sidewall of the sheet cassette. When the sheet cassette and the multi tray overlaid thereon are inserted into the apparatus main body, the boss on the sidewall of the sheet cassette is pressed against the positioning member on the inner wall of the apparatus main body, via the rib protruding outward from the sidewall of the sheet cassette, and the multi tray and the sheet cassette are set in position, with respect to the positioning member.

In another aspect, the disclosure provides an image forming apparatus including the foregoing sheet feeding device, and an image forming device that forms an image on a sheet, drawn out and supplied from the sheet cassette or the multi tray of the sheet feeding device.

DETAILED DESCRIPTION

Figure 1A:
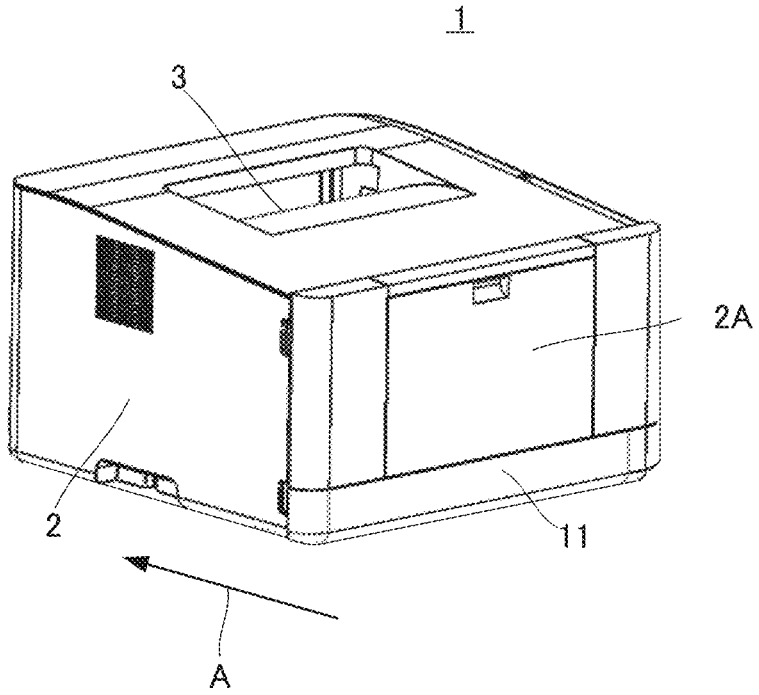
FIG. 1A is a perspective view showing the appearance of an image forming apparatus, incorporated with a sheet feeding device according to an embodiment of the disclosure, a sidewall of an apparatus main body being closed.
Figure 1B:
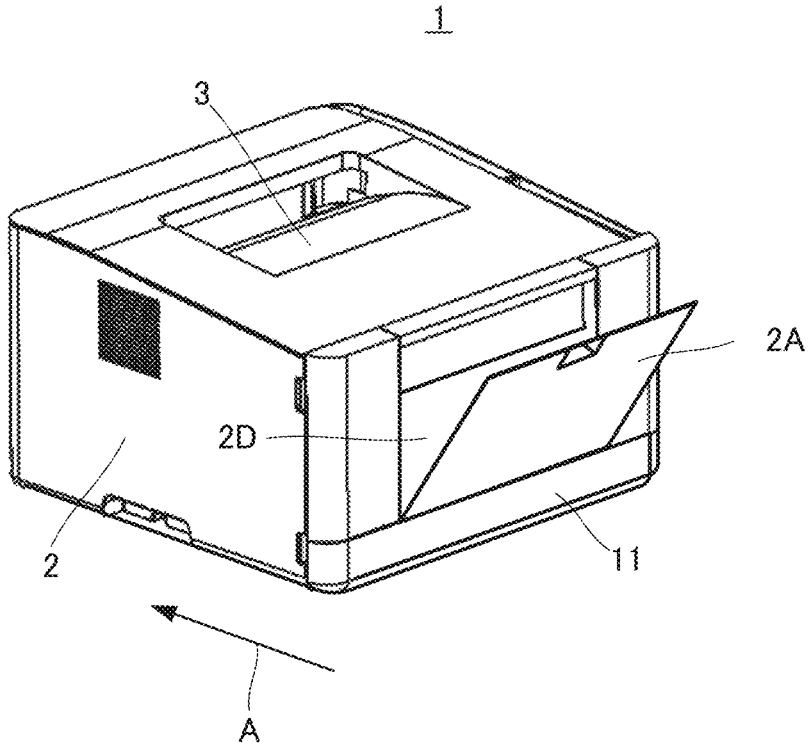
FIG. 1B is a perspective view showing the appearance of the image forming apparatus, incorporated with the sheet feeding device according to the embodiment of the disclosure, the sidewall of the apparatus main body being half opened.
Figure 2:
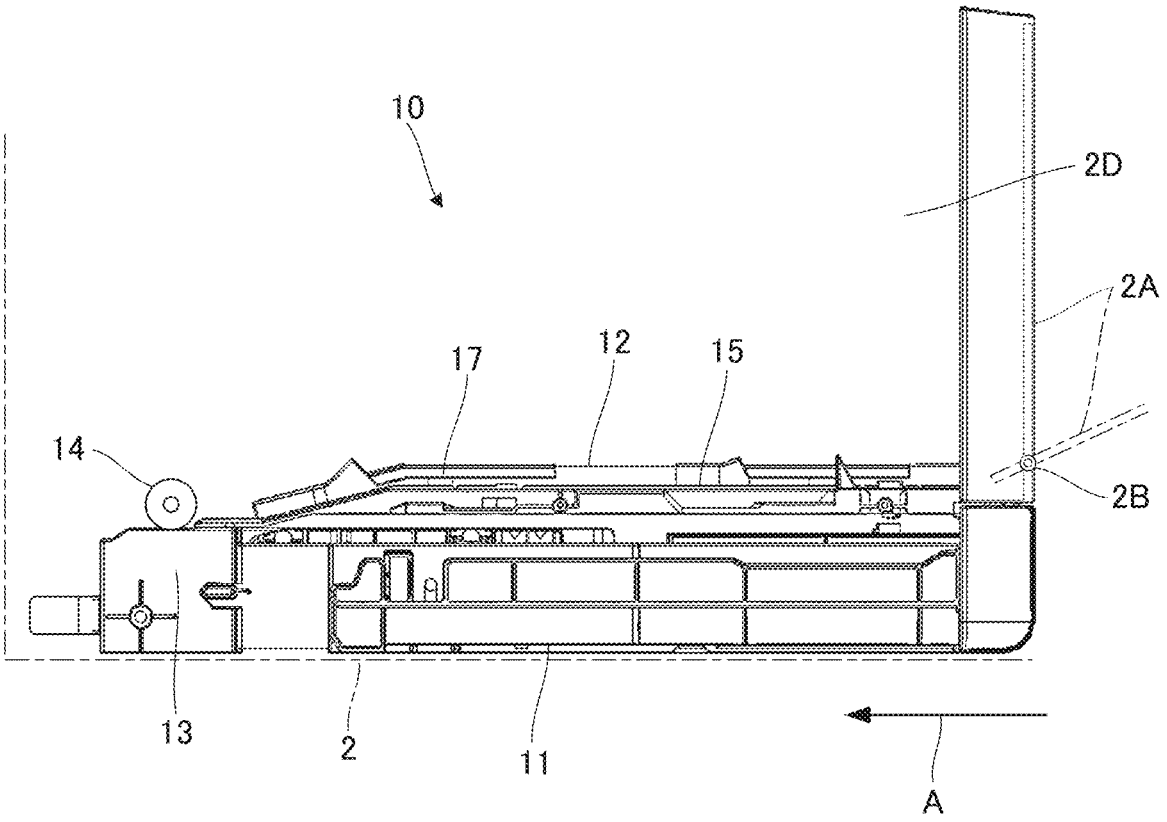
FIG. 2 is a side view showing the sheet feeding device according to the embodiment.
Figure 3:
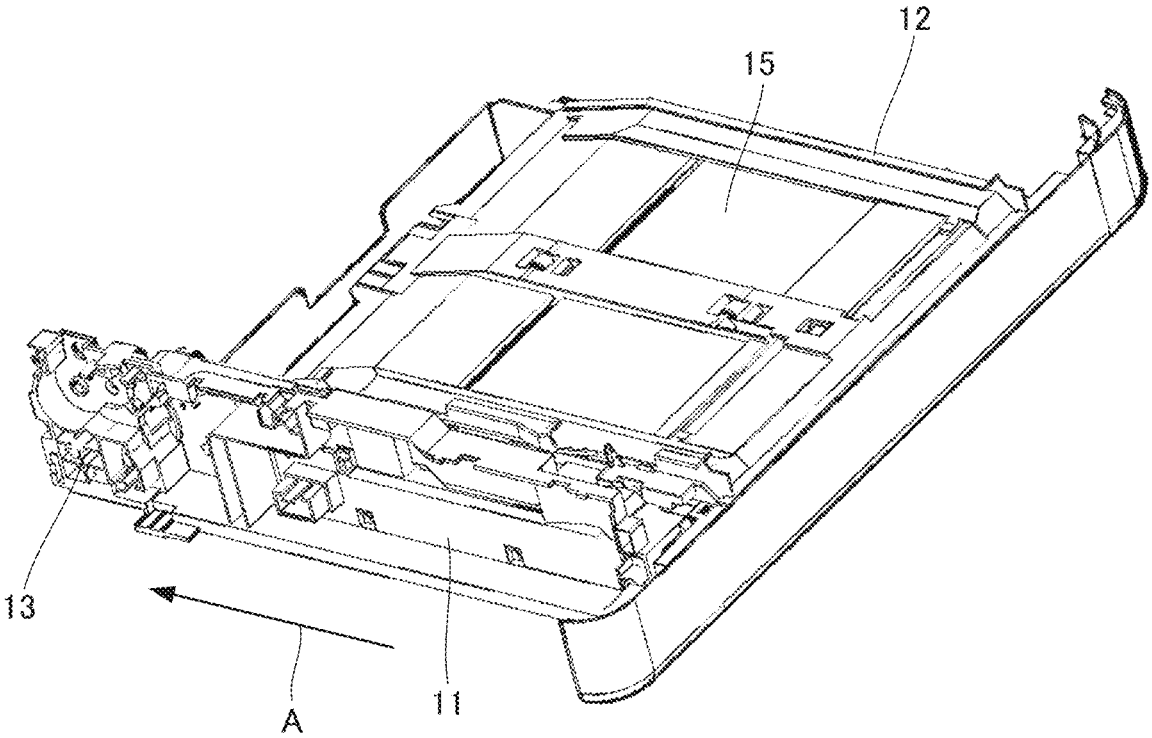
FIG. 3 is a perspective view showing a sheet cassette and a multi tray, in the sheet feeding device according to the embodiment.

Hereafter, an embodiment of the disclosure will be described, with reference to the drawings. FIG. 1A and FIG. 1B are perspective views showing the appearance of an image forming apparatus, incorporated with a sheet feeding device according to an embodiment of the disclosure, FIG. 1A showing a state where a sidewall of the apparatus main body is closed, and FIG. 1B showing a state where the sidewall of the apparatus main body is half opened. FIG. 2 is a side view showing the sheet feeding device according to the embodiment. FIG. 3 is a perspective view showing a sheet cassette and a multi tray, in the sheet feeding device.

Referring to FIG. 1A, FIG. 1B, and FIG. 2, the image forming apparatus 1 is for example a printer. An output tray 3 is provided on the outer side of an apparatus main body 2, and the sheet feeding device 10 according to this embodiment, a non-illustrated image forming device, a non-illustrated fixing device, and so forth are provided inside the apparatus main body 2. The sheet feeding device 10 according to this embodiment includes a sheet cassette 11, a multi tray 12, and a sheet delivery device 13.

The multi tray 12 is removably attached to the sheet cassette 11, so as to be overlaid on the upper side of the sheet cassette 11, thus to be retained by the sheet cassette 11 in a unified form. In the sheet cassette 11, a plurality of recording sheets of a standard size are accommodated. On the multi tray 12, one or more recording sheets of the standard size or a non-standard size are placed. The sheet delivery device 13 includes a pickup roller 14 that draws out and supplies the recording sheet, from the sheet cassette 11 or the multi tray 12.

The image forming device forms an image represented by image data, by an electrophotographic method using toner, on the recording sheet drawn out and supplied from the sheet cassette 11 or the multi tray 12, by the sheet delivery device 13 of the sheet feeding device 10. The recording sheet having the image formed thereon undergoes a fixing operation by the fixing device, and is delivered to the output tray 3.

A sidewall 2A of the apparatus main body 2 of the image forming apparatus 1 is openably supported by a shaft 2B, provided close to the lower end portion of the sidewall 2A.

When the sidewall 2A is opened, an opening 2D communicating with the inner space of the apparatus main body 2 (not an opening for inserting the sheet cassette 11) is exposed. The sidewall 2A is opened in an inclined posture, such that the portion on the side of the apparatus main body 2 becomes lower. The recording sheet is placed on the sidewall 2A opened and inclined, and guided therefrom to the multi tray 12.

As shown in FIG. 2 and FIG. 3, the multi tray 12 includes a guide plate 15 of a generally flat plate shape, on which the recording sheet is placed. The recording sheet, placed on the upper face of the sidewall 2A opened, is guided from the upper face of the sidewall 2A to the sheet delivery device 13, through a transport route 17 on the guide plate 15 of the multi tray 12.

The sheet cassette 11 can be removably inserted through the opening formed in the lower end portion of the apparatus main body 2. Upon being inserted through the opening in the direction of an arrow A, the sheet cassette 11 is mounted inside the apparatus main body 2, and removed therefrom, by being drawn out in the direction opposite to the direction of the arrow A.

The multi tray 12, integrally retained on the upper side of the sheet cassette 11, can also be removably inserted through the opening formed in the lower end portion of the apparatus main body 2. Upon being inserted through the opening in the direction of an arrow A, the multi tray 12 is mounted inside the apparatus main body 2, and removed therefrom, by being drawn out in the direction opposite to the direction of the arrow A.

Figure 4:
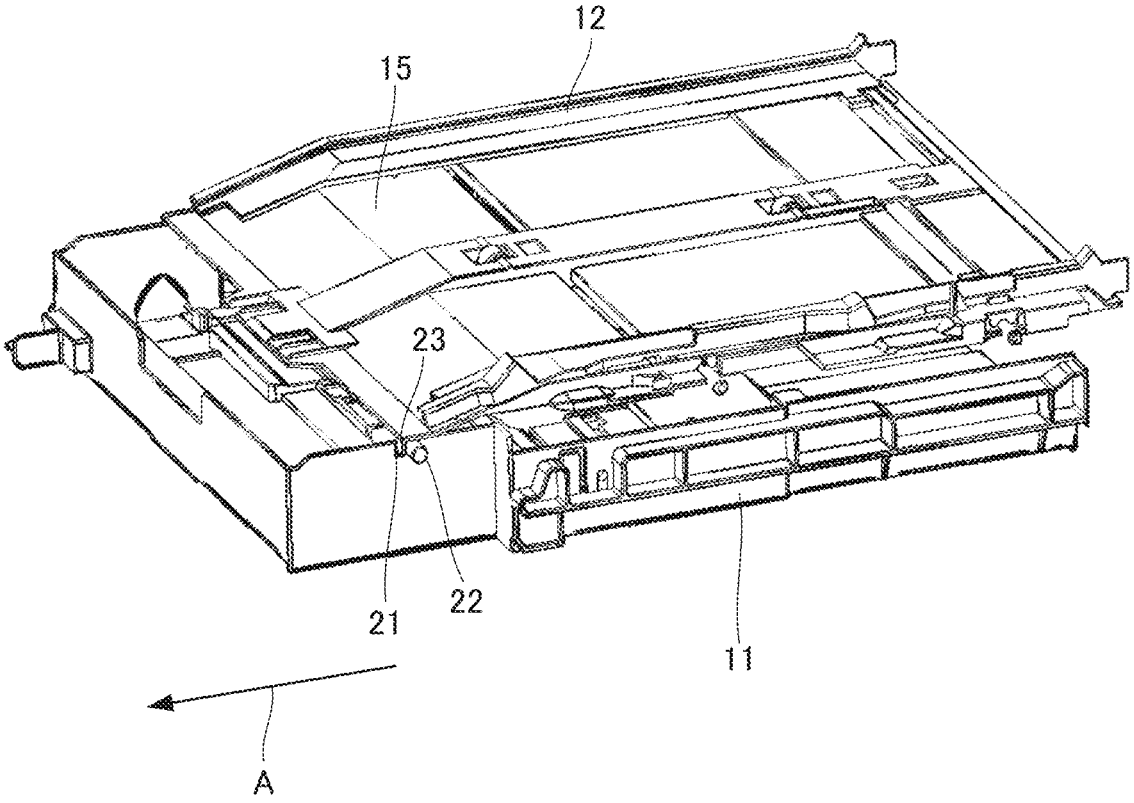
FIG. 4 is a perspective view showing the sheet cassette and the multi tray, seen from the side of the front-end portion thereof.
Figure 5A:
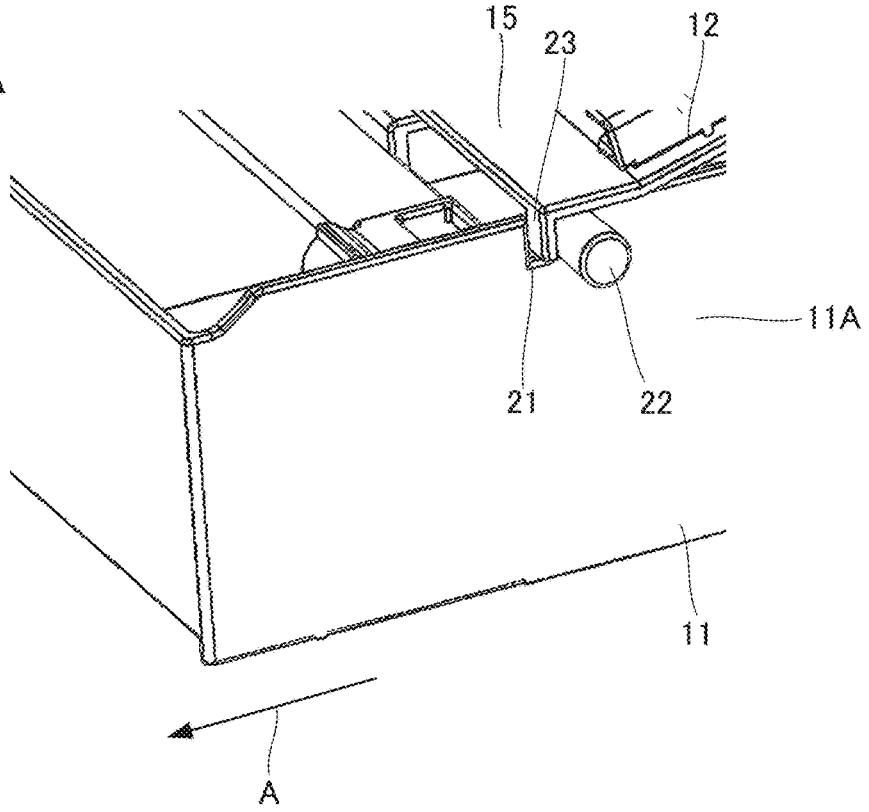
FIG. 5A and FIG. 5B are a perspective view and a side view respectively, showing a portion around the front-end portion of the sheet cassette and the multi tray in an enlarged scale.
Figure 5B:
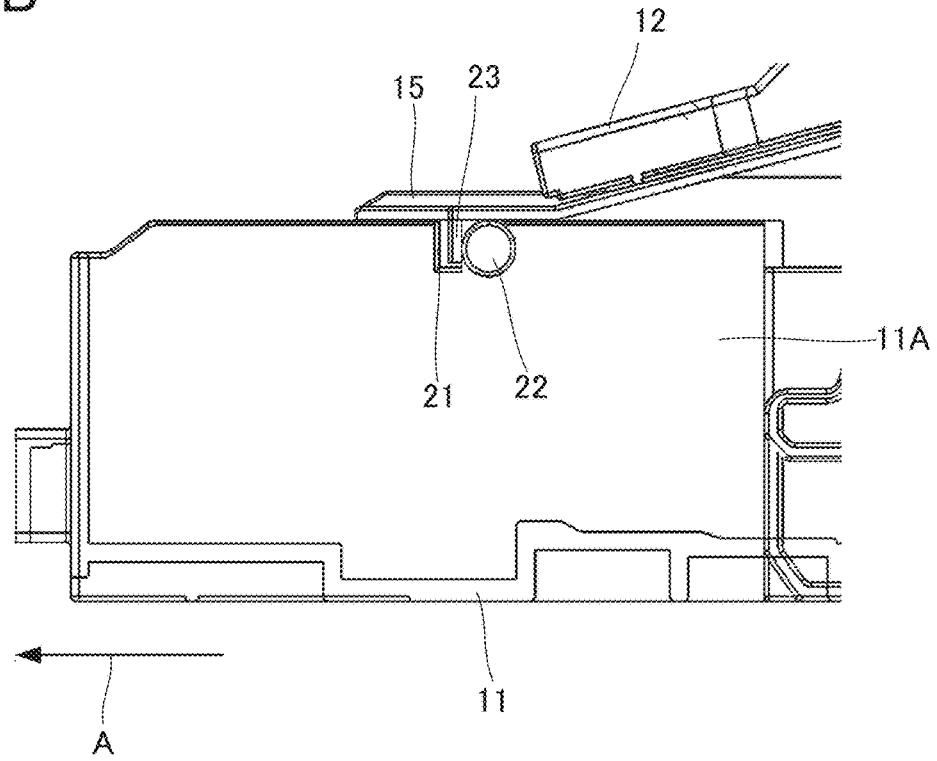

FIG. 4 is a perspective view showing the sheet cassette 11 and the multi tray 12, seen from the side of the front-end portion thereof. FIG. 5A and FIG. 5B are a perspective view and a side view respectively, showing a portion around the front-end portion of the sheet cassette 11 and the multi tray 12 in an enlarged scale.

As shown in FIG. 4, FIG. 5A, and FIG. 5B, an engaging slit 21 is formed in the upper edge of each of sidewalls 11A of the sheet cassette 11. In addition, the sidewalls 11A each include a boss 22, protruding outward (laterally) from the sidewall 11A. The bosses 22 are each located adjacent to the engaging slit 21, on the side to which the sheet cassette 11 is drawn out (opposite to the side indicated by the arrow A).

On each of lateral end portions of the front-end portion of the guide plate 15 of the multi tray 12, a rib 23 is formed so as to protrude downward (toward the sheet cassette 11, when the multi tray 12 is attached thereto). When the multi tray 12 is overlaid on the upper side of the sheet cassette 11, the ribs 23 on the respective sides of the front-end portion of the guide plate 15 are fitted in the respectively corresponding one of the engaging slits 21 on the sidewall 11A of the sheet cassette 11. Accordingly, the multi tray 12 is retained on the upper side of the sheet cassette 11 in a unified form, and the multi tray 12 is prevented from positionally shifting with respect to the sheet cassette 11, in the direction of the arrow A or in the opposite direction.

In addition, a part of each of the ribs 23 on the respective sides of the front-end portion of the guide plate 15 is protruding outward (laterally) from the sidewall 11A of the sheet cassette 11. Such a part of the rib 23 will hereinafter be referred to as protruding portion.

Figure 6:
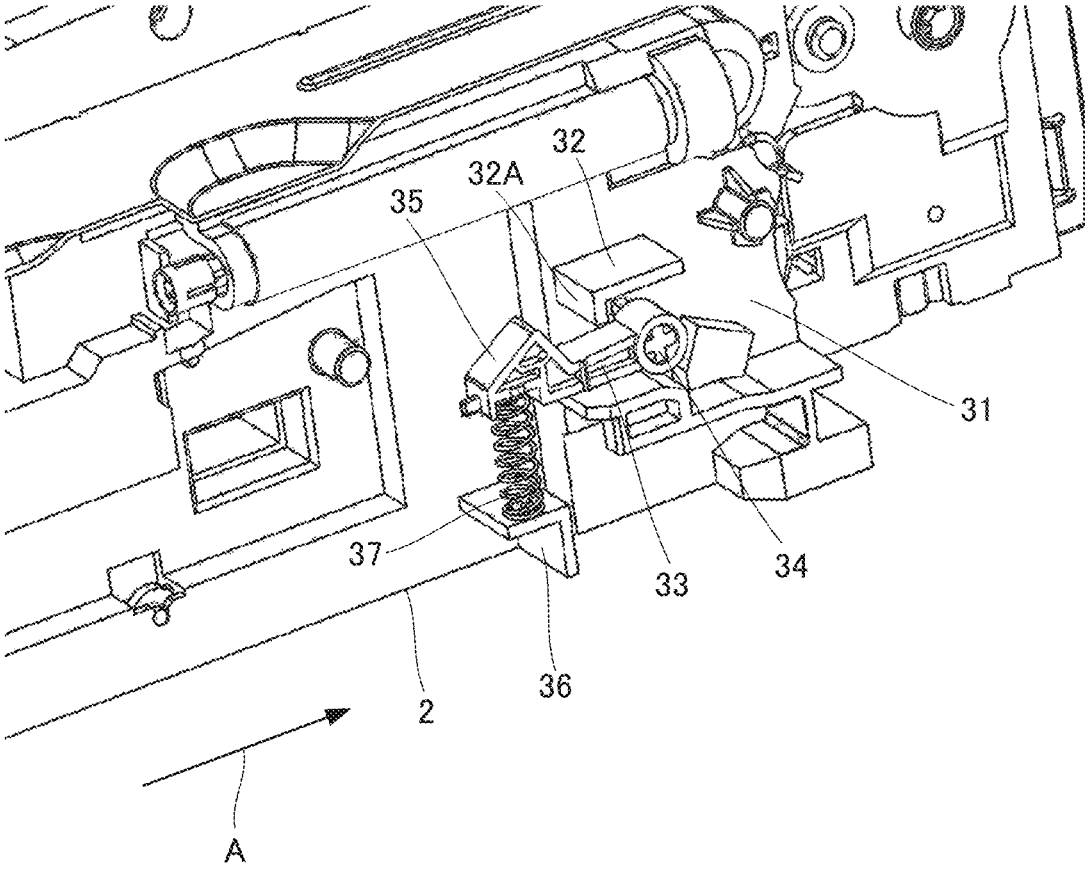
FIG. 6 is a perspective view showing an inner wall of the apparatus main body, in a state where the sheet cassette and the multi tray are not mounted.

FIG. 6 is a perspective view showing an inner wall of the apparatus main body 2, in the state where the sheet cassette 11 and the multi tray 12 are not mounted. FIG. 6 illustrates the inner wall of the apparatus main body 2, to be opposed to the sidewall 11A of the sheet cassette 11, on the near side of the sheet cassette 11 in FIG. 2 to FIG. 5, when the sheet cassette 11 and the multi tray 12 are mounted. Accordingly, the arrow A is indicating the direction opposite to the direction shown in FIG. 2 to FIG. 5.

As shown in FIG. 6, a positioning member 32 is formed on the inner wall 31 of the apparatus main body 2, so as to protrude inward therefrom. The positioning member 32 is bent in an L-shape when viewed from a lateral direction, and includes an abutment surface 32A opposed to the direction of the arrow A. Here, the sheet feeding device 10 also includes, as a part thereof, the positioning member 32.

The inner wall 31 supports a stopper 35 so as to pivot about a shaft 34 sticking out from the inner wall 31. In other words, the stopper 35 has one end portion supported by the shaft 34 provided on the inner wall of the apparatus main body 2, so as to pivot about the shaft 34. A part of the stopper 35 is formed as a lever 33. In addition, a pedestal 36 is formed on the inner wall 31 so as to protrude inward therefrom, and a coil spring 37 is supported on the pedestal 36 in an upright posture, with the upper end of the coil spring 37 located in contact with the lower face of an end portion of the lever 33. The coil spring 37 exemplifies the biasing member in the disclosure. The coil spring 37 is biasing upward the lower side of the other end portion of the stopper 35, opposite to the mentioned end portion, thereby urging the stopper 35 to pivot about the shaft 34.

Figure 7:
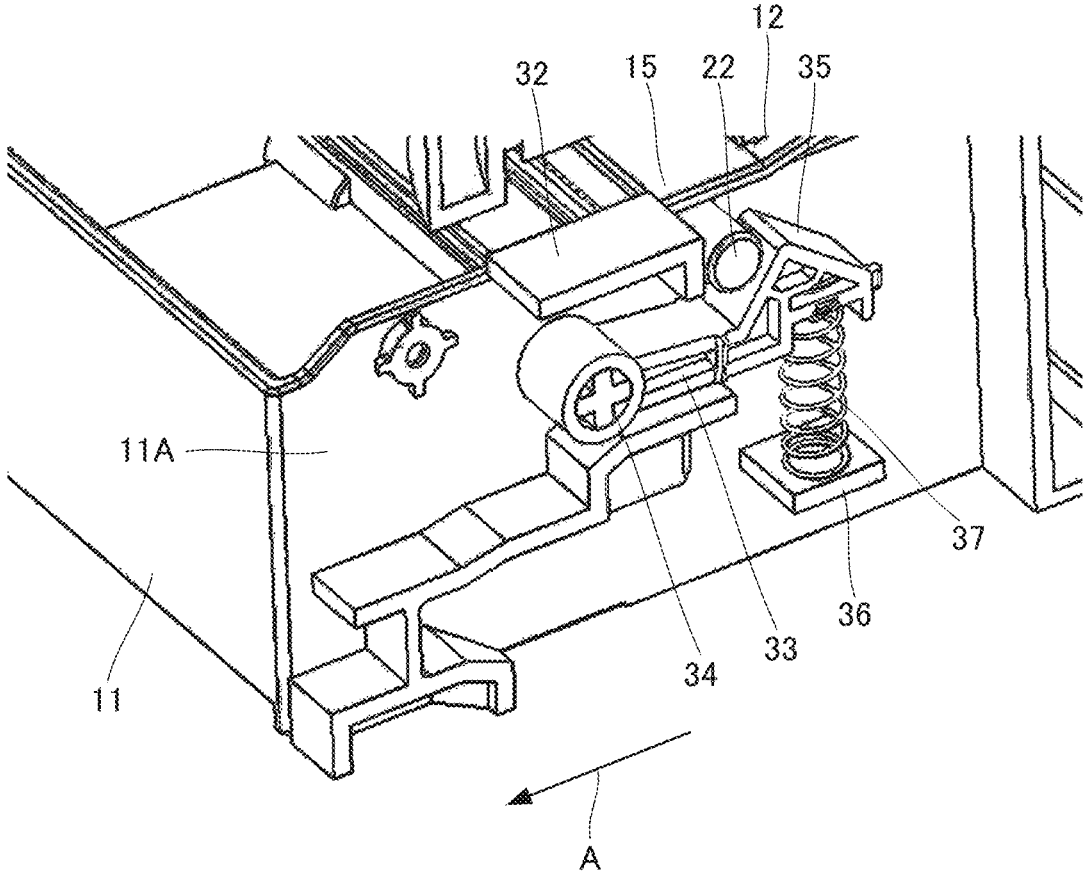
FIG. 7 is a perspective view showing a positioning member and a lever on the inner wall of the apparatus main body, a boss on the sidewall of the sheet cassette, and a rib on a guide plate of the multi tray, in the state where the sheet cassette and the multi tray are mounted.
Figure 8:
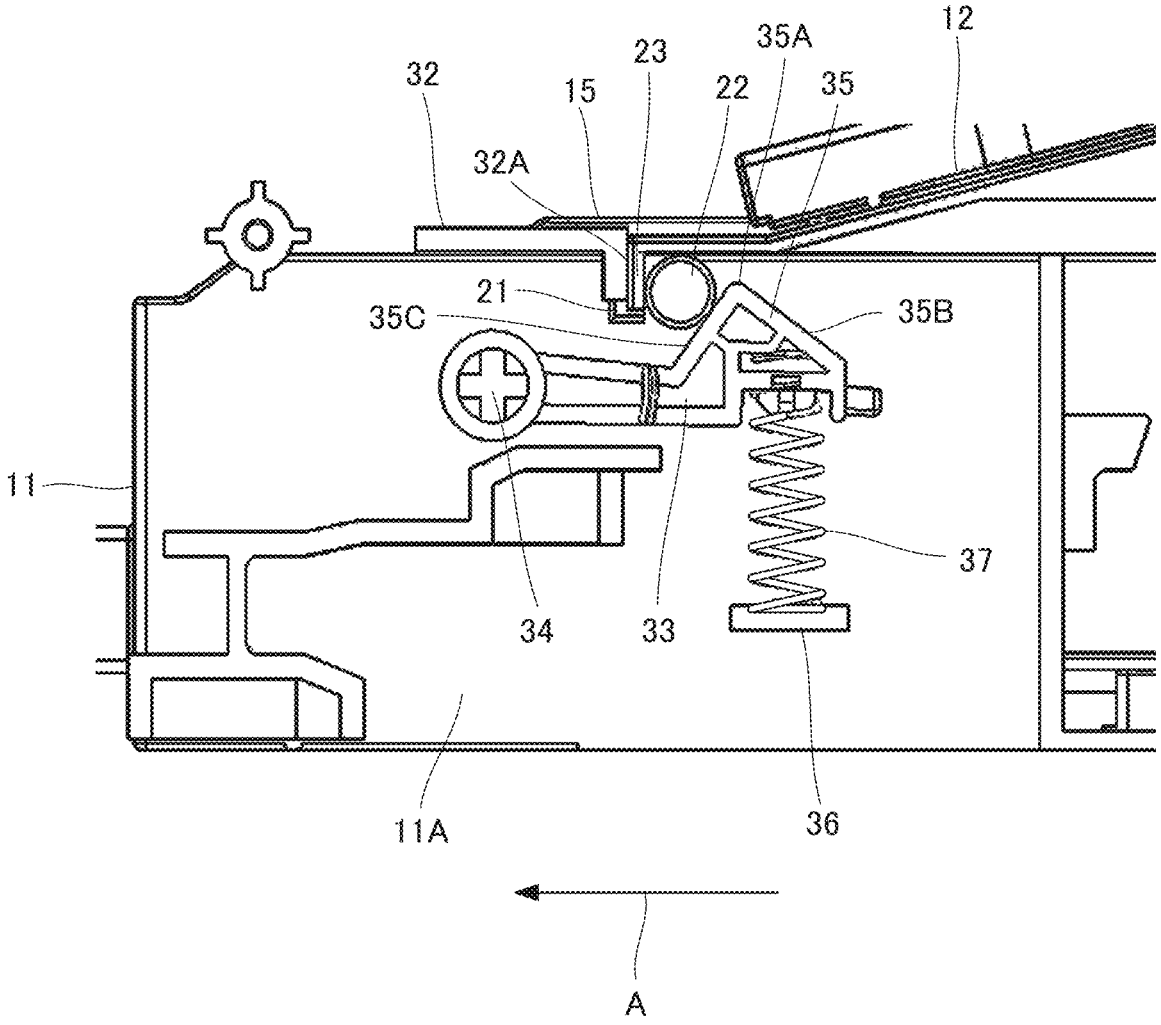
FIG. 8 is a side view showing the positioning member and the lever on the inner wall of the apparatus main body, the boss on the sidewall of the sheet cassette, and the rib on the guide plate of the multi tray, in the state where the sheet cassette and the multi tray are mounted.
Figure 9A:
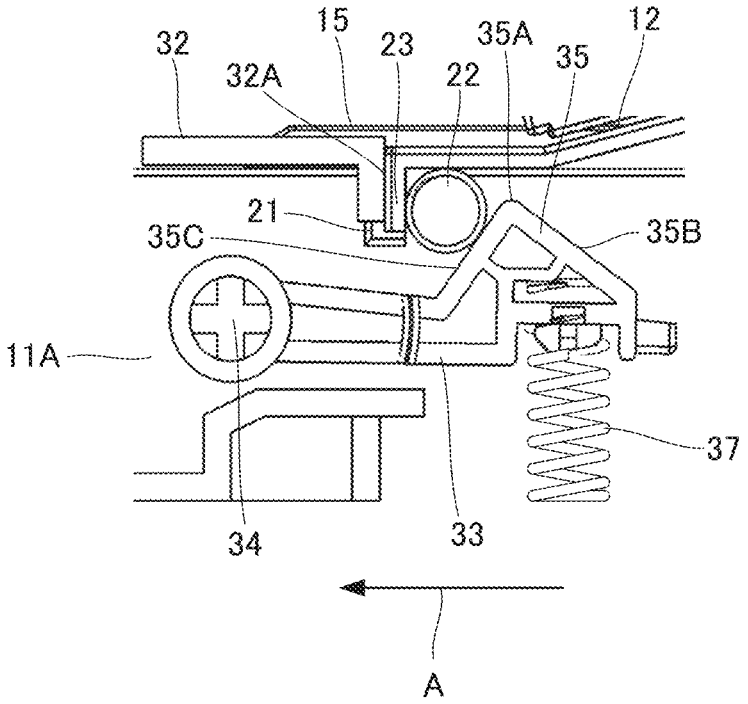
FIG. 9A and FIG. 9B are a side view and a plan view respectively, showing the positioning member and the lever on the inner wall of the apparatus main body, the boss on the sidewall of the sheet cassette, and the rib on the guide plate of the multi tray, in an enlarged scale, in the state where the sheet cassette and the multi tray are mounted.
Figure 9B:
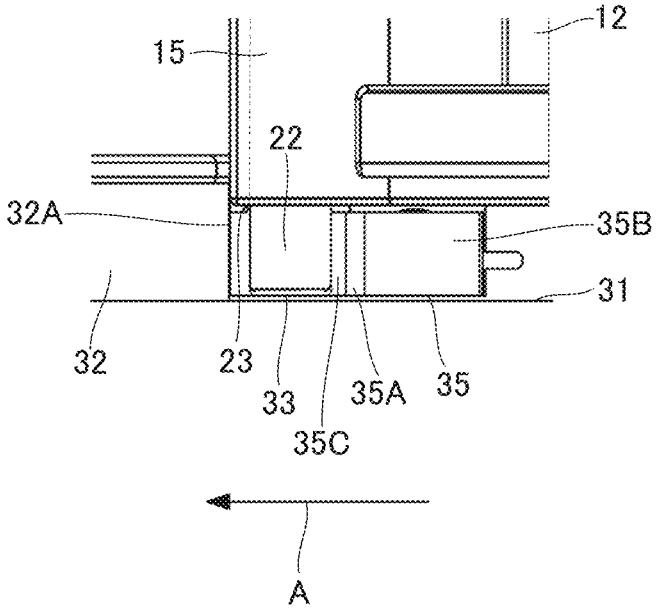

FIG. 7 and FIG. 8 are a perspective view and a side view respectively, showing the positioning member 32 and the lever 33 on the inner wall 31 of the apparatus main body 2, the boss 22 on the sidewall 11A of the sheet cassette 11, and the rib 23 on the guide plate 15 of the multi tray 12, in the state where the sheet cassette 11 and the multi tray 12 are mounted. FIG. 9A and FIG. 9B are a side view and a plan view respectively, showing the positioning member 32 and the lever 33 on the apparatus main body 2, the boss 22 on the sheet cassette 11, and the rib 23 on the multi tray 12, in an enlarged scale, in the same state as FIG. 7 and FIG. 8. Here, the inner wall 31 of the apparatus main body 2 is not shown in FIG. 7, FIG. 8, and FIG. 9A, but only shown in FIG. 9B.

As shown in FIG. 8, FIG. 9A, and FIG. 9B, the stopper 35 formed in a hill shape includes a summit 35A, a first sloped surface 35B inclined downward from the summit 35A in the direction opposite to the direction of the arrow A, and a second sloped surface 35C inclined downward from the summit 35A in the direction of the direction of the arrow A. In other words, the stopper 35 includes, around the mentioned end portion, the summit 35A, the first sloped surface 35B inclined downward from the summit 35A toward the side of the opening, and the second sloped surface 35C inclined downward from the summit 35A toward the deeper side of the apparatus main body 2 along the insertion direction of the sheet cassette 11.

As is apparent from FIG. 9B, when the sheet cassette 11 is inserted in the direction of the arrow A, the positioning member 32 protruding inward from the inner wall 31 of the apparatus main body 2 is contacted by the protruding portion of the rib 23 of the multi tray 12, protruding outward from the sidewall 11A of the sheet cassette 11.

When the sheet cassette 11 is inserted in the direction of the arrow A, in addition, the lever 33 of the stopper 35 on the apparatus main body 2 passes by the protruding portion of the rib 23 of the multi tray 12, without being contacted thereby, and is contacted by the boss 22 of the sheet cassette 11.

Thus, when the rib 23 is caught between the positioning member 32 and the boss 22, the summit 35A of the stopper 35 is located on the side of the opening of the apparatus main body 2 (opening for inserting the sheet cassette 11) in the insertion direction of the sheet cassette 11, and urged to pivot upward about the shaft 34 by the biasing force of the coil spring 37, so that the second sloped surface 35C is abutted against the boss 22, to thereby bias the boss 22 toward the deeper side of the apparatus main body 2.

As shown in FIG. 7, FIG. 8, FIG. 9A, and FIG. 9B, when the sheet cassette 11 and the multi tray 12 are mounted inside the apparatus main body 2, the protruding portion of the rib 23 of the multi tray 12, and the boss 22 on the sidewall 11A of the sheet cassette 11 are caught between the abutment surface 32A of the positioning member 32 on the apparatus main body 2, and the second sloped surface 35C of the stopper 35, thus to be set in position.

In addition, the end portion of the lever 33 is biased upward by the coil spring 37 on the pedestal 36 of the apparatus main body 2, so that the second sloped surface 35C of the stopper 35 biases the boss 22 of the sheet cassette 11 in the direction of the arrow A. Accordingly, the boss 22 of the sheet cassette 11 is pressed against the abutment surface 32A of the positioning member 32 of the apparatus main body 2, via the protruding portion of the rib 23 of the multi tray 12, so that the protruding portion of the rib 23 of the multi tray 12 and the boss 22 of the sheet cassette 11 are retained between the abutment surface 32A of the positioning member 32 and the second sloped surface 35C of the stopper 35.

Therefore, the protruding portion of the rib 23 of the multi tray 12 and the boss 22 of the sheet cassette 11 are set in position, with respect to the positioning member 32 of the apparatus main body 2, and consequently the multi tray 12 and the sheet cassette 11 are mounted inside the apparatus main body 2, in the properly positioned state.

Figure 10A:
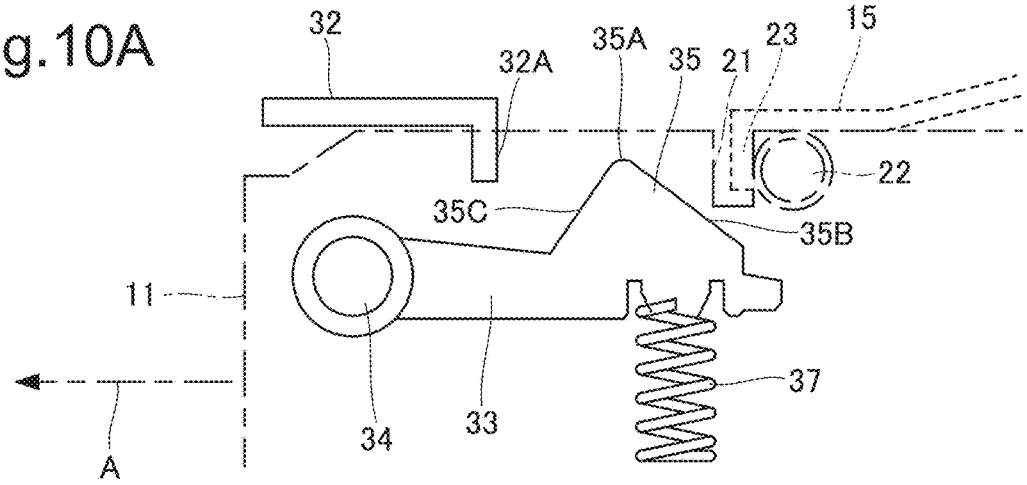
FIG. 10A, FIG. 10B, and FIG. 10C are schematic side views each showing the action of the positioning member and the lever of the apparatus main body, the boss on the sheet cassette, and the rib on the multi tray, performed when the sheet cassette and the multi tray are inserted to and removed from inside of the apparatus main body.
Figure 10B:
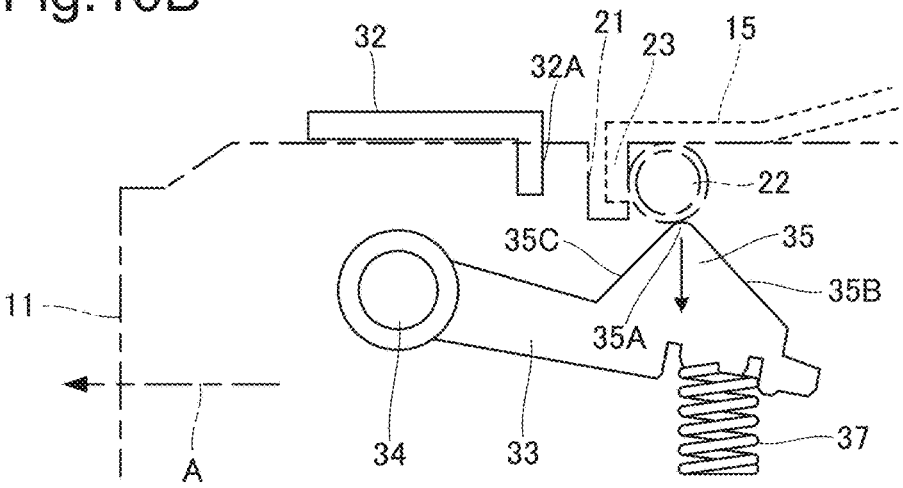
Figure 10C:
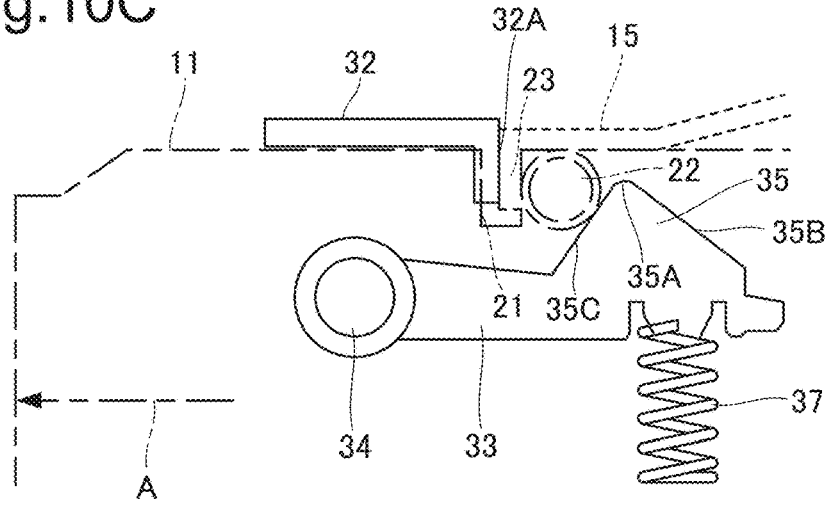

FIG. 10A, FIG. 10B, and FIG. 10C each schematically illustrate the action of the positioning member 32 and the lever 33 of the apparatus main body 2, the boss 22 on the sheet cassette 11, and the rib 23 on the multi tray 12, performed when the sheet cassette 11 and the multi tray 12 are inserted to and removed from the inside of the apparatus main body 2.

Referring to FIG. 10A, the sheet cassette 11 and the multi tray 12 are inserted into the inside of the apparatus main body 2, in the direction of the arrow A, with the multi tray 12 overlaid on the upper side of the sheet cassette 11, and the rib 23 at the front-end portion of the guide plate 15 of the multi tray 12 fitted in the engaging slit 21 on the sidewall 11A of the sheet cassette 11.

Referring to FIG. 10B, when the sheet cassette 11 and the multi tray 12 are moved further in the direction of the arrow A, the protruding portion of the rib 23 of the multi tray 12 passes by the stopper 35 without contacting the same, so that the boss 22 of the sheet cassette 11 is abutted against the first sloped surface 35B of the stopper 35. Accordingly, the boss 22 of the sheet cassette 11 pushes the first sloped surface 35B of the stopper 35 downward, against the biasing force of the coil spring 37 of the apparatus main body 2, and steps over the summit 35A of the stopper 35.

Referring to FIG. 10C, when the protruding portion of the rib 23 of the multi tray 12 is abutted against the abutment surface 32A of the positioning member 32 of the apparatus main body 2, the boss 22 of the sheet cassette 11 is pressed against the abutment surface 32A of the positioning member 32 of the apparatus main body 2, via the protruding portion of the rib 23, thus to be restricted from moving further. Accordingly, the protruding portion of the rib 23 of the multi tray 12 and the boss 22 of the sheet cassette 11 are caught between the abutment surface 32A of the positioning member 32 and the second sloped surface 35C of the stopper 35, thus to be set in position. Further, the coil spring 37 of the apparatus main body 2 biases the second sloped surface 35C of the stopper 35 upward, so that the second sloped surface 35C biases the boss 22 of the sheet cassette 11 in the direction of the arrow A. Therefore, the protruding portion of the rib 23 of the multi tray 12 and the boss 22 of the sheet cassette 11 are retained between the abutment surface 32A of the positioning member 32 and the second sloped surface 35C of the stopper 35. Thus, the multi tray 12 and the sheet cassette 11 are inserted in the unified form, and mounted in the properly positioned state.

When the sheet cassette 11 and the multi tray 12 are to be removed from the inside of the apparatus main body 2 in the direction opposite to the arrow A, from the positioned state, the boss 22 of the sheet cassette 11 pushes the second sloped surface 35C of the stopper 35 downward, against the biasing force of the coil spring 37 of the apparatus main body 2, and steps over the summit 35A of the stopper 35. Therefore, the sheet cassette 11 and the multi tray 12 can be quickly drawn out, in the unified form.

As described thus far, in the sheet feeding device 10 according to the embodiment, when the sheet cassette 11 and the multi tray 12 are inserted into the inside of the apparatus main body 2, in the direction of the arrow A, the protruding portion of the rib 23 of the multi tray 12 and the boss 22 of the sheet cassette 11 are caught between the abutment surface 32A of the positioning member 32 on the apparatus main body 2 and the second sloped surface 35C of the stopper 35, thus to be set in position. Therefore, the multi tray 12 and the sheet cassette 11 can be inserted in the unified form, and mounted in the properly positioned state.

In addition, since there is no need to provide a component for positioning, for each of the sheet cassette 11 and the multi tray 12 separately, the number of parts can be reduced and the structure can be simplified. Further, a positional shift between the sheet cassette 11 and the multi tray 12 can be prevented.

On the aforementioned known multi-size cassette, the sheet materials of two different sizes are placed side by side. Such a cassette inevitably has to be twice as large in size or more, compared with a cassette for the sheet material of a single size, and is therefore difficult to handle, and incurs an increase in size of the apparatus.

In the case where the sheet cassette and the multi tray are stacked in the up-down direction, the increase in size of the sheet cassette and the multi tray can be avoided, and therefore the apparatus can be made smaller in size. In this case, however, since the sheet cassette and the multi tray, stacked in the up-down direction, have to be inserted into the inside of the apparatus main body and set in position, the component for positioning has to be provided for each of the sheet cassette and the multi tray, which leads to an increase in number of parts and complication of the structure. Besides, the sheet cassette and the multi tray are prone to be positionally shifted, relative to each other.

In contrast, the configuration according to the foregoing embodiment enables the sheet cassette 11 and the multi tray 12 to be inserted into the inside of the apparatus main body 2 in the unified form, and set in position, with the simple structure as described above.

Although the image forming apparatus according to the disclosure is exemplified by the printer in the embodiment, the image forming apparatus may instead be a multifunction peripheral, a copier, or a facsimile machine.

Further, the configuration described in the foregoing embodiments with reference to FIG. 1 to FIG. 10 is merely exemplary, and in no way intended to limit the disclosure to those configuration.

While the present disclosure has been described in detail with reference to the embodiments thereof, it would be apparent to those skilled in the art that the various changes and modifications may be made therein within the scope defined by the appended claims.

What is claimed is:

1. A sheet feeding device to be installed in an image forming apparatus, the sheet feeding device comprising:

a sheet cassette configured to be removably inserted into inside of an apparatus main body of the image forming apparatus, through an opening in the apparatus main body;

a multi tray configured to be removably overlaid on an upper side of the sheet cassette;

an engaging slit formed in an upper edge of a sidewall of the sheet cassette;

a boss located adjacent to the engaging slit, on a side to which the sheet cassette is drawn out, and protruding in a lateral direction from the sidewall of the sheet cassette;

a rib protruding downward from a front-end portion of the multi tray, and a positioning member protruding from an inner wall of the apparatus main body, wherein, when the multi tray is overlaid on the sheet cassette, the rib on the front-end portion of the multi tray is fitted in the engaging slit in the upper edge of the sidewall of the sheet cassette, and protrudes outward from the sidewall of the sheet cassette, and when the sheet cassette and the multi tray overlaid thereon are inserted into the apparatus main body, the boss on the sidewall of the sheet cassette is pressed against the positioning member on the inner wall of the apparatus main body, via the rib protruding outward from the sidewall of the sheet cassette, and the multi tray and the sheet cassette are set in position, with respect to the positioning member.

2. The sheet feeding device according to claim 1, further comprising:

a stopper supported by the apparatus main body such that an end portion can pivot in an up-down direction; and a biasing member that biases the end portion of the stopper upward, wherein the stopper is abutted against the boss by being biased upward by the biasing member, when the rib is caught between the positioning member and the boss, and biases the boss in an insertion direction of the sheet cassette, toward a deeper side in the apparatus main body.

3. The sheet feeding device according to claim 2, wherein the stopper has the other end portion supported by a shaft provided on the inner wall of the apparatus main body, so as to pivot about the shaft, and the biasing member causes the stopper to pivot about the shaft, by biasing a lower side of the end portion of the stopper upward.

4. The sheet feeding device according to claim 3, wherein the stopper includes, on the end portion, a summit, a first sloped surface inclined downward from the summit toward a side of the opening of the apparatus main body, and a second sloped surface inclined downward from the summit toward the deeper side in the apparatus main body, in the insertion direction, and when the multi tray and the sheet cassette move from the opening toward the deeper side in the apparatus main body, the rib of the multi tray passes by the first sloped surface without contacting the first sloped surface, and the boss of the sheet cassette is abutted against the first sloped surface, thereby pushing the first sloped surface downward against a biasing force of the biasing member, and steps over the summit of the stopper and moves toward the deeper side of the apparatus main body.

5. The sheet feeding device according to claim 3, wherein the stopper includes, on the end portion, a summit, a first sloped surface inclined downward from the summit toward a side of the opening of the apparatus main body, and a second sloped surface inclined downward from the summit toward the deeper side in the apparatus main body, in the insertion direction, and when the rib is caught between the positioning member and the boss, the summit of the stopper is located on the side of the opening of the apparatus main body in the insertion direction, the stopper pivots about the shaft by being biased upward by the biasing member, and the second sloped surface is abutted against the boss, thereby biasing the boss in the insertion direction, toward the deeper side in the apparatus main body.

6. The sheet feeding device according to claim 1, further comprising a sheet delivery device that draws out a sheet from the sheet cassette or the multi tray, and transports the sheet.

7. An image forming apparatus comprising:

the sheet feeding device according to claim 1; and an image forming device that forms an image on a sheet, drawn out and supplied from the sheet cassette or the multi tray of the sheet feeding device.

* * * * *